US008722289B2

(12) United States Patent
Takamura

(10) Patent No.: US 8,722,289 B2
(45) Date of Patent: May 13, 2014

(54) ELECTROPHOTOGRAPHIC PHOTORECEPTOR AND IMAGE-FORMING APPARATUS

(75) Inventor: Hiroaki Takamura, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 245 days.

(21) Appl. No.: 13/149,215

(22) Filed: May 31, 2011

(65) Prior Publication Data

US 2011/0294055 A1 Dec. 1, 2011

(30) Foreign Application Priority Data

May 31, 2010 (JP) ..... 2010-124832

(51) Int. Cl.
*G03G 5/04* (2006.01)
*G03G 15/06* (2006.01)

(52) U.S. Cl.
USPC ..... 430/96; 430/59.6; 399/159; 399/162

(58) Field of Classification Search
USPC ..... 430/59.6, 69, 96; 399/159, 162
See application file for complete search history.

(56) References Cited

U.S. PATENT DOCUMENTS

| | | | | |
|---|---|---|---|---|
| 4,378,416 | A * | 3/1983 | Yanagawa et al. | 430/56 |
| 5,554,473 | A * | 9/1996 | Cais et al. | 430/58.4 |
| 2009/0232551 | A1 | 9/2009 | Nagao et al. | |
| 2009/0257776 | A1 * | 10/2009 | Mitsumori et al. | 399/159 |
| 2010/0209136 | A1 | 8/2010 | Mizushima et al. | |
| 2011/0311271 | A1 | 12/2011 | Takamura | |

FOREIGN PATENT DOCUMENTS

| | | | |
|---|---|---|---|
| EP | 0 701 175 | A1 | 3/1996 |
| EP | 0 767 411 | A1 | 4/1997 |
| JP | 61-105550 | | 5/1986 |
| JP | 8-106168 | | 4/1996 |
| JP | 9-171263 | | 6/1997 |
| JP | 10-158380 | | 6/1998 |
| JP | 2000-019752 | | 1/2000 |

* cited by examiner

*Primary Examiner* — Jonathan Jelsma
(74) *Attorney, Agent, or Firm* — Oblon, Spivak, McClelland, Maier & Neustadt, L.L.P.

(57) ABSTRACT

It is to provide a sheet-shaped electrophotographic photoreceptor which has an uncoated area, is good in mechanical adhesiveness between the photosensitive layer and the sheet-shaped conductive substrate but excellent ease of peeling with a solvent, and is further good in electrical properties. The electrophotographic photoreceptor comprises a sheet-shaped conductive substrate and a photosensitive layer provided thereon, wherein the electrophotographic photoreceptor contains a photosensitive layer-uncoated area within the sheet surface, and the photosensitive layer contains a copolycarbonate resin having an extremely restricted specific structure.

11 Claims, 3 Drawing Sheets

ELECTROPHOTOGRAPHIC PHOTORECEPTOR AND IMAGE-FORMING APPARATUS

TECHNICAL FIELD

The present invention relates to a sheet-shaped electrophotographic photoreceptor for use in on-demand printers, copiers, printers, and the like. More particularly, the invention relates to a sheet-shaped electrophotographic photoreceptor having excellent adhesiveness to a sheet-shaped conductive substrate and also excellent ease of peeling with a solvent and good electric properties, and an image-forming apparatus having the same mounted thereon.

BACKGROUND OF THE INVENTION

Since instantaneousness and high-quality images are obtained, electrophotography has been used extensively in the fields of on-demand printers, copiers, various printers, and the like.

As photoreceptors serving as the core of electrophotography, use is being made of photoreceptors employing an organic photoconductive material which has advantages such as non-polluting properties, ease of film formation, and ease of production.

Photoreceptors employing an organic photoconductive material include: a so-called dispersion type photoreceptor containing photoconductive fine particles disperses in a binder resin; and a multilayer type photoreceptor having superposed layers including a charge-generating layer and a charge-transporting layer. The multilayer type photoreceptor has the following advantages: the multilayer type photoreceptor can be obtained as a high-sensitivity photoreceptor by using a charge-generating material having a high efficiency in combination with a charge-transporting material having a high efficiency; there is a wide choice of material and highly safe photoreceptors are obtained; and, since the photosensitive layer can be easily formed by coating, the multilayer type photoreceptor has high productivity and is advantageous also in view of cost. Therefore, the multilayer type photoreceptors are the mainstream of photoreceptors, and have been diligently developed and put to practical use.

Of these, for the reasons that the form is flexible and freedom at disposition in an apparatus is large, an endless belt-shaped photoreceptor obtained by linking a sheet-shaped photoreceptor at end parts thereof has been used by preference. Also, for the reasons that a photoreceptor having a wide area can be easily produced and the photoreceptor is easily changed inexpensively, a photoreceptor in a form where a sheet-shaped photoreceptor is wound on a drum has been used by preference (e.g., see Patent Documents 1 and 2).

Since the electrophotographic photoreceptor is repeatedly used in an electrophotographic process, i.e., in a cycle including charging, exposure, development, transfer, cleaning, erase, and the like, the photoreceptor is deteriorated by various stresses during the process. The deterioration includes such chemical and electrical deterioration that strongly acidic ozone and NOx generated from a corona charging unit used as a charging unit cause chemical damage to the photoreceptor and a photosensitive layer composition is decomposed by the flow of carriers formed by image exposure or erasing light or is decomposed by external light. Moreover, as deterioration other than the above, there is mechanical deterioration such as wear of the surface of the photosensitive layer, generation of scratches thereon, and exfoliation of a film caused by sliding with cleaning blades and magnetic brushes, contact with a transfer member or paper, and the like. Also, particularly in the endless belt-shaped photoreceptor, cracks may be generated on the surface of the photoreceptor owing to flexure and tension generated at the time when the photoreceptor repeatedly passes around rollers which constitutes a belt unit. In particular, the damage generated on the surface of the photosensitive layer is prone to appear on an image and directly impairs quality of the image, so that the damage becomes a large factor of limiting the life of the photoreceptor. Namely, in order to develop a long-life photoreceptor, it is an essential condition to increase mechanical strength together with enhancement of electrical and chemical durability.

Moreover, the sheet-shaped photoreceptor is difficult to secure adhesiveness between a conductive substrate and the photosensitive layer owing to the flexibility of the photoreceptor, so that there is a concern of exfoliation of the photosensitive layer.

In the case of a general photoreceptor having no functional layer such as a surface protective layer, the layer receiving such loads is the photosensitive layer. The photosensitive layer is usually composed of a binder resin and a photoconductive material, and the binder resin substantially determines the strength. However, since the doping amount of the photoconductive material is considerably large, a sufficient mechanical strength has not yet been realized.

As binder resins for the photosensitive layer, use has been made of vinyl polymers such as poly(methyl methacrylate), polystyrene, and polyvinyl chloride and copolymers thereof, thermoplastic resins such as polycarbonate, polyester, polysulfone, phenoxy, epoxy, and silicone resins, and various thermosetting resins. Of the numerous binder resins, polycarbonate resins have relatively excellent performance and thus various polycarbonate resins have hitherto been developed and put to practical use (e.g., see Patent Documents 3 to 6).

DOCUMENT LIST

[Patent Document 1] JP-UM-A-6-16966
[Patent Document 2] JP-A-2000-10315
[Patent Document 3] JP-A-50-98332
[Patent Document 4] JP-A-59-71057
[Patent Document 5] JP-A-59-184251
[Patent Document 6] JP-A-5-21478

SUMMARY OF THE INVENTION

In the case where an uncoated area is present within the sheet surface, conventional sheet-shaped photoreceptors have a problem that exfoliation starts from the boundaries and it is an actual state that a binder resin usable for maintaining the adhesiveness between the conductive substrate and the photosensitive layer is limited. Therefore, it is difficult to secure sufficiently good electrical properties.

Moreover, in the preparation of the uncoated area, there is a case where a part of a photosensitive layer is peeled with a solvent from a photoreceptor sheet where the whole area of a sheet-shaped conductive substrate is coated with the photosensitive layer. However, the peeling with the solvent is difficult in some cases depending on the binder resin and this fact has put restrictions on practical use. Since the ease of peeling of the photosensitive layer with a solvent is mainly controlled by solubility of the binder resin of the photosensitive layer, selection of the solvent and the binder resin becomes important but there is a problem that a resin having low solubility (bisphenol A polycarbonate resin or the like which is widely used in the sheet-shape electrophotographic photoreceptor) is soluble only in solvents having low safety (1,4-dioxane and chlorobenzene). Therefore, in the commercialization, it is a current situation that a material should be selected from resins having high solubility.

The present invention is performed for the purpose of solving such problems.

Namely, an object of the invention is to provide a sheet-shaped electrophotographic photoreceptor which has an uncoated area, is good in mechanical adhesiveness between the photosensitive layer and the sheet-shaped conductive substrate but excellent ease of peeling with a solvent, and is further good in electrical properties.

The present inventors diligently made investigations. As a result, they have found that mechanical adhesiveness with the sheet-shaped conductive substrate becomes good and on the other hand, ease of peeling with a solvent is excellent, and further good electrical properties are exhibited by incorporating a copolycarbonate resin having an extremely restrictive specific structure into the photosensitive layer of the sheet shaped electrophotographic photoreceptor. The invention has been thus completed.

Namely, the first gist of the invention lies on an electrophotographic photoreceptor comprising a sheet-shaped conductive substrate and a photosensitive layer provided thereon, wherein the electrophotographic photoreceptor contains a photosensitive layer-uncoated area within the sheet surface, and the photosensitive layer contains a copolycarbonate resin having a repeating structure represented by the following general formula (1):

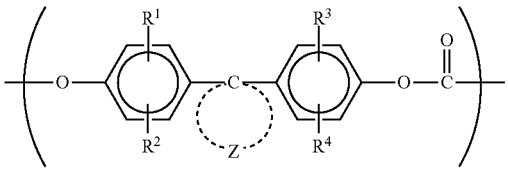

wherein $R^1$, $R^2$, $R^3$ and $R^4$ each independently represent a hydrogen atom or an alkyl group having 4 or less carbon atoms, Z forms a saturated cyclic aliphatic alkyl group having 5 to 8 carbon atoms including the carbon atom to be bonded, and the saturated cyclic aliphatic alkyl group has one to three methyl groups as substituent(s).

The second gist of the invention lies on the aforementioned electrophotographic photoreceptor, wherein the copolycarbonate resin is a copolymer of the repeating structure represented by the general formula (1) above and a repeating structure represented by the following structural formula (2):

Structural formula (2)

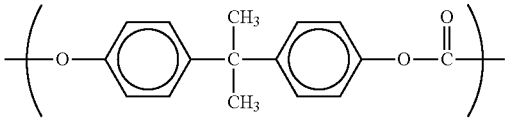

The third gist of the invention lies on the electrophotographic photoreceptor, wherein, in the copolycarbonate resin, the molar ratio of the repeating structure represented by the structural formula (2) is larger than the molar ratio of the repeating structure represented by the general formula (1), more preferably lies on the electrophotographic photoreceptor, wherein the molar ratio of the repeating structure represented by the structural formula (2) is twice or more the molar ratio of the repeating structure represented by the general formula (1), and also, lies on the electrophotographic photoreceptor, wherein the general formula (1) is represented by the following structural formula (3):

Structural formula (3)

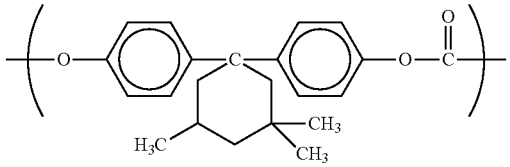

The fourth gist of the invention lies on the electrophotographic photoreceptor, wherein the thickness of the photosensitive layer is 17 μm or larger, and also lies on the electrophotographic photoreceptor, which contains an insulated part within the sheet surface.

The fifth gist of the invention lies on an image-forming apparatus comprising the aforementioned electrophotographic photoreceptor.

According to the invention, a sheet-shaped electrophotographic photoreceptor which is good in mechanical adhesiveness between the photosensitive layer and the sheet-shaped conductive substrate but excellent ease of peeling with a solvent, and exhibits good electrical properties, can be obtained.

DESCRIPTION OF REFERENCE NUMERALS AND SIGNS

Figure 1:
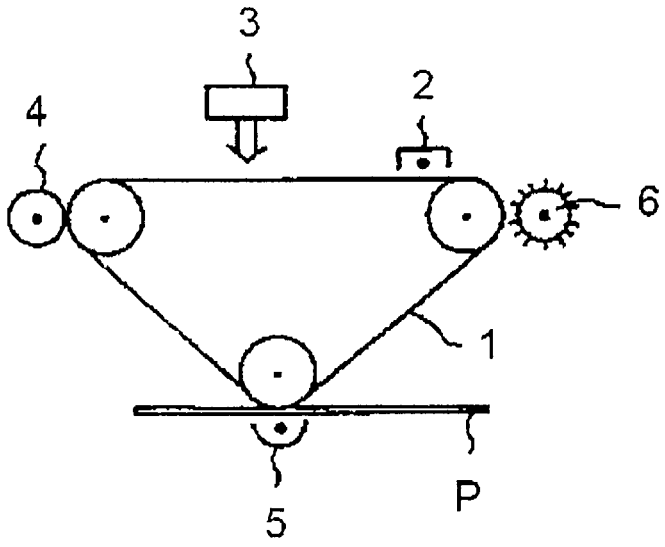
FIG. 1 is a conceptual illustration showing one embodiment of the image-forming apparatus using the electrophotographic photoreceptor of the invention.

1 Photoreceptor
2 Charging device (charging roller)
3 Exposure device
4 Developing device
5 Transfer device
6 Cleaner
P Recording paper

DETAILED DESCRIPTION OF THE INVENTION

Best modes for carrying out the invention will be explained below in detail. The invention should not be construed as being limited to the following embodiments, and various modifications of the invention can be made within the spirit of the invention.

The electrophotographic photoreceptor of the invention has a sheet-shaped conductive substrate and a photosensitive layer provided thereon, a photosensitive layer-uncoated area is present within the sheet surface, the photosensitive layer contains a polycarbonate resin having a specific repeating structure of the invention, and the resin is used as a binder resin of the photosensitive layer to be provided on the conductive substrate of the photoreceptor.

The specific constitution of the photosensitive layer of the invention includes a multilayer type photoreceptor formed by superposing, on a conductive substrate, a charge-generating layer including a charge-generating material as a main component and a charge-transporting layer including a charge-transporting material and a binder resin as main components; and a dispersion type (single-layer type) photoreceptor having a photosensitive layer which is formed on a conductive substrate and which includes a charge-transporting material and a binder resin and contains a charge-generating material dispersed therein. In the invention, the polycarbonate resin having a specific repeating structure is used in the photosensitive layer in the single-layer type photoreceptor, preferably in the charge-transporting layer of the multilayer type photosensitive layer.

<Conductive Substrate>

As the conductive substrate of the invention, one obtained by laminating a metal layer on an insulated part such as a resin or paper, particularly a biaxially oriented film, is preferred. Materials of the biaxially oriented film include linear polyester resins such as polyethylene terephthalate and polybutylene terephthalate, polyolefin resins such as polyethylene and polypropylene, polyvinyl chloride, and the like. From the standpoints of mechanical strength and dimensional stability, the linear polyester resins, particularly polyethylene terephthalate is preferred. The thickness of the film is usually from 30 to 150 μm, preferably from 50 to 120 μm, and further preferably from 70 to 100 μm.

Moreover, the metal for the metal layer (e.g., metal deposition layer) constituting the conductive substrate includes copper, nickel, zinc, aluminum, ITO (indium-tin oxide), and the like. Of these, aluminum is preferred. The thickness of the metal layer is usually from about 40 to 100 nm. The vapor deposition onto the resin film is performed by a known vapor-deposition method of the metal, such as electrical heat-melt vapor-deposition method, an ion-beam vapor-deposition method, or an ion plating method.

As the metal layer, use can be made of a metal foil such as an aluminum foil or a nickel foil or a laminated film obtained by superposing these metals. The metal foil in this case preferably has a thickness of 5 μm or less. Also, a conductive material having an appropriate resistance value can be further superposed on the metal foil.

The surface of the substrate may be smooth or may have been roughened by mixing particles having a large particle diameter at the time of resin film formation.

<Polycarbonate Resin>

The photosensitive layer of the electrophotographic photoreceptor of the invention contains a copolycarbonate resin having a repeating structure represented by the following general formula (1):

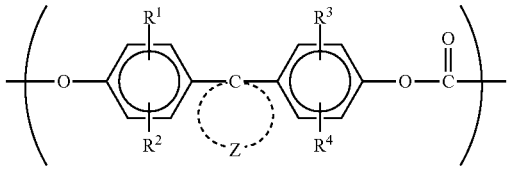

wherein in formula (1), $R^1$, $R^2$, $R^3$ and $R^4$ each independently represent a hydrogen atom or an alkyl group having 4 or less carbon atoms, Z forms a saturated cyclic aliphatic alkyl group having 5 to 8 carbon atoms including the carbon atom to be bonded, and the saturated cyclic aliphatic alkyl group has one to three methyl groups as substituent(s).

Moreover, the polycarbonate resin having the repeating structure represented by the above general formula (1) may have a copolymerization component. As the copolymerization component, a repeating structure represented by the following general formula (2) is preferred. Furthermore, the above general formula (1) is preferably represented by the following structural formula (3).

Structural formula (2)

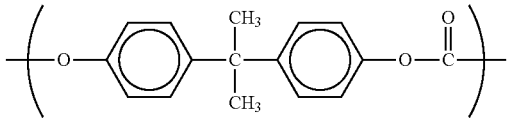

Structural formula (3)

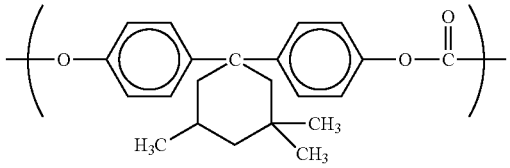

Moreover, the polycarbonate resin having the repeating structure represented by the above general formula (1) is particularly preferably represented by the following general formula (4). With regard to m and n, m is preferably less than n and further, 2m is preferably equal to or less than n.

General formula (4)

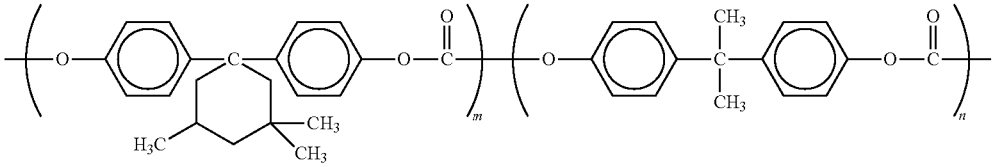

The polycarbonate resin of the invention can be used in the electrophotographic photoreceptor as a mixture with other resin(s). The resins to be used in combination include vinyl polymers such as poly(methyl methacrylate), polystyrene, and polyvinyl chloride and copolymers thereof, thermoplastic resins such as polycarbonate, polyester, polyesterpolycarbonate, polysulfone, phenoxy, epoxy, and silicone resins, and various thermosetting resins. Of these resins, polycarbonate resins and polyarylate resins are preferred.

The mixing ratio of the resins to be used in combination is not particularly limited but, in order to obtain the advantage of the invention sufficiently, the other resins are preferably used within the range not exceeding the ratio of the polycarbonate resin of the invention and particularly, the other resins are preferably not used in combination.

<Undercoat Layer>

An undercoat layer may be disposed between the conductive substrate and the photosensitive layer in order to improve adhesiveness, nonblocking properties, etc.

As the undercoat layer, use may be made of a resin, a material obtained by dispersing particles of a metal oxide in a resin, or the like. Examples of the metal oxide particles for use in the undercoat layer include particles of a metal oxide containing one metallic element, such as titanium oxide, aluminum oxide, silicon oxide, zirconium oxide, zinc oxide, or iron oxide, and particles of a metal oxide containing two or more metallic elements, such as calcium titanate, strontium titanate, or barium titanate. Metal oxide particles of one kind only may be used, or a mixture of two or more kinds of metal oxide particles may be used. Preferred of these particulate metal oxides are titanium oxide and aluminum oxide. Particularly preferred is titanium oxide. The titanium oxide particles may be ones in which the surface thereof has undergone a treatment with an inorganic substance, e.g., tin oxide, aluminum oxide, antimony oxide, zirconium oxide, or silicon oxide, or with an organic substance, e.g., stearic acid, a polyol, or a silicone. The crystal form of the titanium oxide particles may be any of rutile, anatase, brookite, and amorphous. Two or more crystalline states may be included.

With respect to particle diameter, metal oxide particles having various particle diameters can be used. However, metal oxide particles having a particle diameter of from 10 nm to 100 nm in terms of average primary-particle diameter are preferred from the standpoints of properties and liquid stability. Particularly preferred are metal oxide particles having a particle diameter of from 10 nm to 50 nm.

It is desirable that an undercoat layer should be formed so as to be constituted of a binder resin and metal oxide particles dispersed in the resin. As the binder resin for use in the undercoat layer, use may be made of a phenoxy, epoxy, polyvinylpyrrolidone, poly(vinyl alcohol), casein, poly(acrylic acid), cellulose derivative, gelatin, starch, polyurethane, polyimide, polyamide, or the like. Such a polymer can be used alone or in a cured form obtained with a curing agent. Of these, an alcohol-soluble copolyamide, modified polyamide, or the like is preferred because such polyamides show satisfactory dispersibility and applicability.

The proportion of the inorganic particles to be added to the binder resin can be selected at will. However, from the standpoints of the stability and applicability of the dispersion, it is preferred to use the inorganic particles in an amount ranging from 10 parts by weight to 500 parts by weight per 100 parts by weight of the binder resin.

The thickness of the undercoat layer can be selected at will. However, the thickness thereof is preferably from 0.1 μm to 25 μm from the standpoints of photoreceptor characteristics and applicability. A known antioxidant and the like may be added to the undercoat layer.

<Charge-Generating Layer>

In the case where the electrophotographic photoreceptor of the invention is of the multilayer type, examples of charge-generating materials usable in the charge-generating layer thereof include various photoconductive materials such as selenium and alloys thereof, cadmium sulfide, and other inorganic photoconductive materials, and organic pigments including phthalocyanine pigments, azo pigments, quinacridone pigments, indigo pigments, perylene pigments, polycyclic quinone pigments, anthanthrone pigments, and benzimidazole pigments. Of these, organic pigments are preferred. In particular, phthalocyanine pigments and azo pigments are preferred. Particles of these charge-generating materials are used in the state of being bound with various binder resins such as, e.g., polyester resins, poly(vinyl acetate), poly(acrylic ester)s, poly(methacrylic ester)s, polyesters, polycarbonates, poly(vinyl acetoacetal), poly(vinyl propional), poly(vinyl butyral), phenoxy resins, epoxy resins, urethane resins, cellulose esters, and cellulose ethers. In this case, a charge-generating material may be used in such a proportion that the amount of the charge-generating material is in the range of from 30 parts by weight to 500 parts by weight per 100 parts by weight of the binder resin. A suitable film thickness of the charge-generating layer is generally from 0.1 μm to 1 μm, preferably from 0.15 μm to 0.6 μm.

In the case where a phthalocyanine compound is used as a charge-generating material, use may be made of metal-free phthalocyanines and phthalocyanine compounds to which a metal, e.g., copper, indium, gallium, tin, titanium, zinc, vanadium, silicon, or germanium, or an oxide, halide, or another form of the metal has coordinated. Examples of ligands for metal atoms having a valence of 3 or higher include, in addition to an oxygen atom and a chlorine atom shown above, a hydroxyl group and an alkoxy group. Especially suitable are X-form and τ-form metal-free phthalocyanines, which have high sensitivity, A-form, B-form, D-form, and other titanyl phthalocyanines, vanadyl phthalocyanines, chloroindium phthalocyanines, chlorogallium phthalocyanines, and hydroxygallium phthalocyanines. Of the crystal forms of titanyl phthalocyanines shown above, the A-form and B-form were referred to as I-phase and II-phase, respectively, by W. Heller et al. (Zeit. Kristallogr., 159 (1982) 173), and the A-form is known as a stable form. The D-form is a crystal form characterized by showing a distinct peak at a diffraction angle $2\theta \pm 0.2°$ of 27.3° in powder X-ray diffractometry using a CuKα line. A single phthalocyanine compound may be used alone, or some phthalocyanine compounds may be used in the state of being mixed with each other. In the case where phthalocyanine compounds are to be used in a mixed state, the constituent elements may be mixed later together and used. Alternatively, the phthalocyanine compounds may be ones the mixed state of which was generated in a production/treatment step of the phthalocyanine compounds, such as, e.g., synthesis, pigment formation, or crystallization. Known as such treatments are an acid paste treatment, grinding, solvent treatment, and the like.

<Charge-Transporting Layer>

The charge-transporting layer of the multilayer type photoreceptor contains a charge-transporting material and also usually contains the binder resin and other component(s) that may be used as needed. The charge-transporting layer may be specifically obtained as follows. For example, the charge-transporting material and the like and the binder resin are dissolved or dispersed in a solvent to prepare a coating fluid, which is then applied onto a charge-generating layer in the case of a normal multilayer type photosensitive layer or applied on a conductive substrate (on an undercoat layer in the case where the undercoat layer is provided) in the case of a reverse multilayer type photosensitive layer, followed by drying.

The charge-transporting material is not particularly limited and any material can be used. Examples of known charge-transporting materials include electron-attracting materials such as aromatic nitro compounds, e.g., 2,4,7-trinitrofluorenone, cyano compounds, e.g., tetracyanoquinodimethane, and quinone compounds, e.g., diphenoquinone, heterocyclic compounds such as carbazole derivatives, indole derivatives, imidazole derivatives, oxazole derivatives, pyrazole derivatives, thiadiazole derivatives, and benzofuran derivatives, and electron-donating materials such as aniline derivatives, hydrazone derivatives, aromatic amine derivatives, stilbene derivatives, butadiene derivatives, enamine derivatives, compounds constituted of two or more of these compounds bonded to each other, and polymers having, in the main chain or side chains thereof, a group derived from any of these compounds. Preferred of these are carbazole derivatives, aromatic amine derivatives, stilbene derivatives, butadiene derivatives, enamine derivatives, and compounds composed of two or more of these compounds bonded to each other. Any one of these charge-transporting materials may be used alone or two or more thereof may be used in any combination.

Specific examples of preferred structures of the charge-transporting material are shown below. These specific examples are shown for illustration and any known charge-transporting materials may be used unless they depart from the gist of the invention.

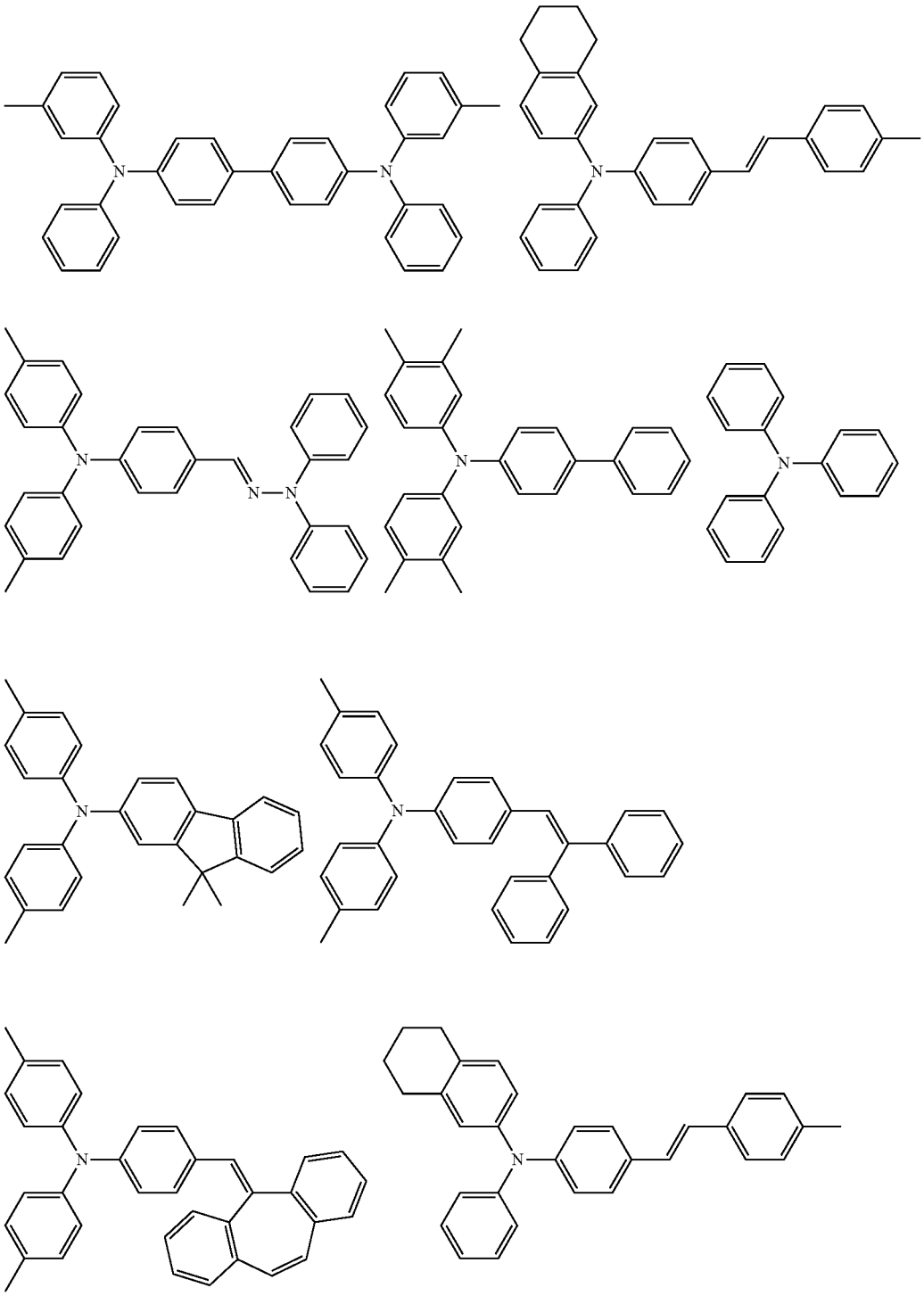

-continued
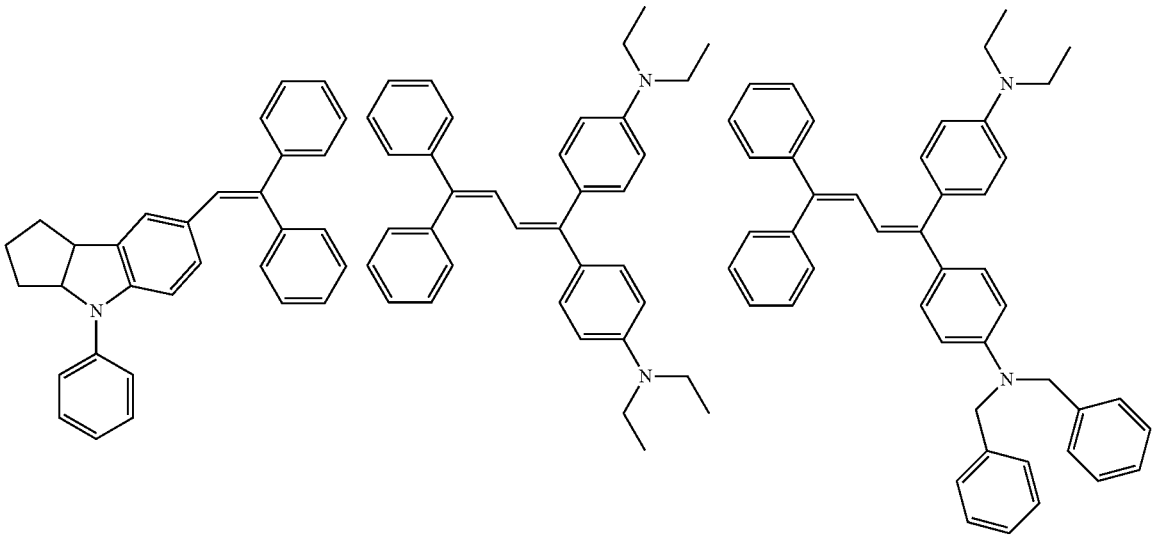
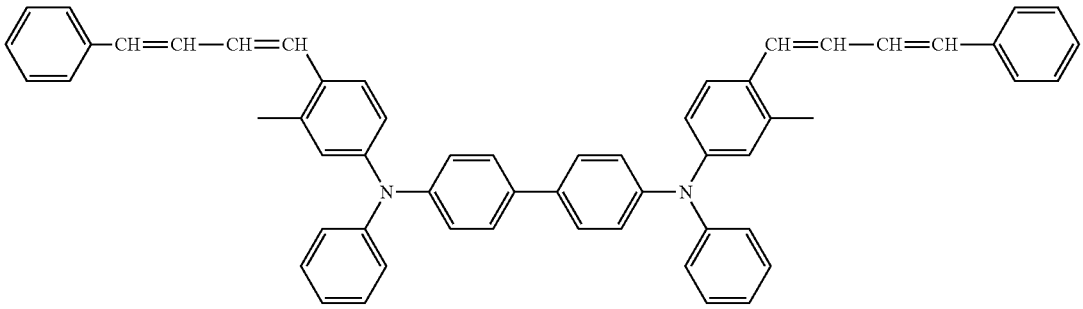
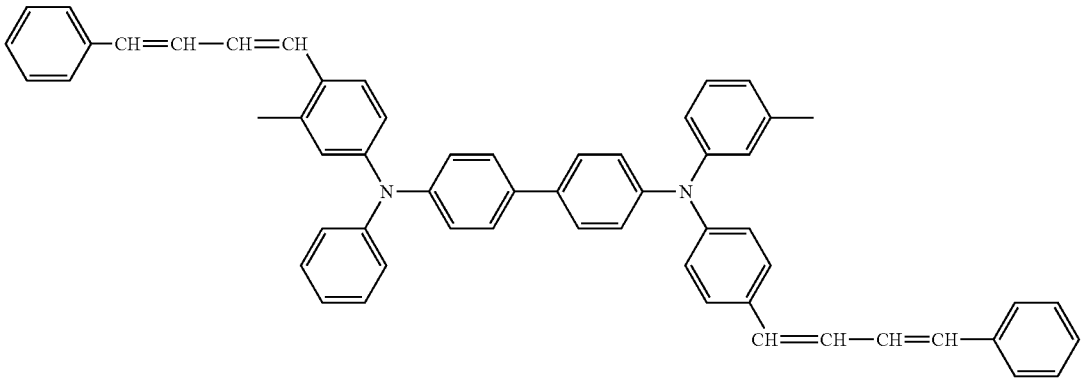
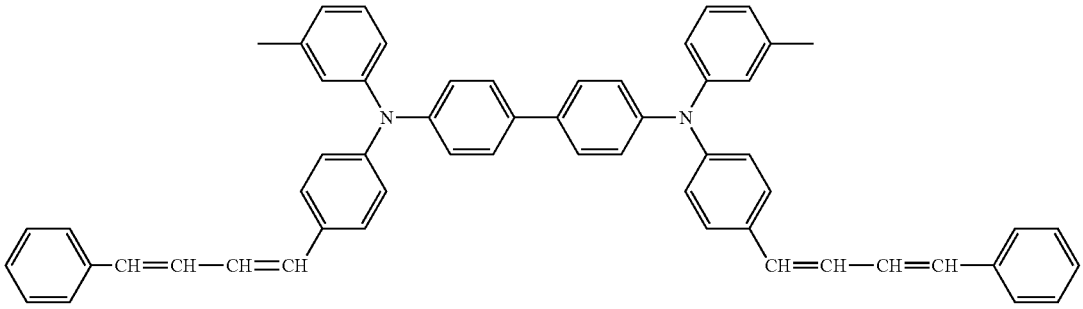

-continued

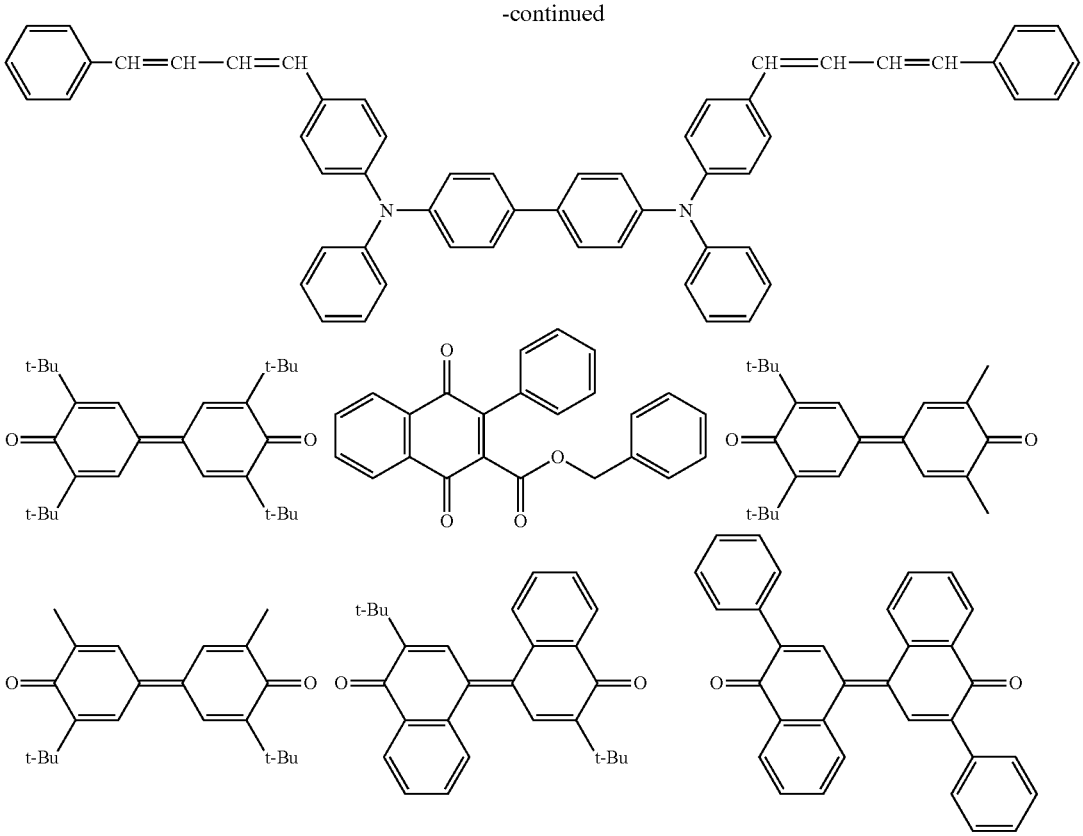

Such charge-transporting material is bound with a binder resin including a polycarbonate resin of the invention to form a charge-transporting layer. The charge-transporting layer may be composed of a single layer, or may be composed of superposed layers differing in component or composition.

The proportion of the charge-transporting material to the binder resin is usually from 30 to 200 parts by weight, preferably from 40 to 150 parts by weight per 100 parts by weight of the binder resin. The effect of the use of the polycarbonate resin according to the invention becomes remarkable particularly when the proportion of the charge-transporting material is small. The charge-transporting material is used in a proportion of preferably 65 parts by weight or smaller, more preferably 55 parts by weight or smaller, and further preferably 45 parts by weight or smaller per 100 parts by weight of the binder resin.

The film thickness of the charge-transporting layer may be generally from 5 to 50 μm, preferably from 10 to 45 μm but the effect of the use of the polycarbonate resin according to the invention becomes remarkable particularly when the thickness is 17 μm or larger.

Well-known additives such as a plasticizer, an antioxidant, an ultraviolet absorber, an electron-attracting compound, a dye, a pigment, and a leveling agent may be incorporated into the charge-transporting layer in order to improve film-forming properties, flexibility, applicability, fouling resistance, gas resistance, light resistance, etc. Examples of the antioxidant include hindered phenol compounds and hindered amine compounds. Examples of the dye and pigment include various colorant compounds and azo compounds.

<Dispersion Type (Single-Layer Type) Photosensitive Layer>

In the case of dispersion type photosensitive layer, the charge-generating material described above is dispersed in a charge-transporting medium having a composition such as that shown above.

In this case, it is necessary that the charge-generating material should have a sufficiently small particle diameter and the charge-generating material is used in a particle diameter of preferably 1 μm or smaller, more preferably 0.5 μm or smaller. In the case where the amount of the charge-generating material to be dispersed in the photosensitive layer is too small, sufficient sensitivity is not obtained. Too large amounts thereof exert an adverse influence to result in a decrease in electrification characteristics, decrease in sensitivity, etc. For example, the charge-generating material is used in an amount preferably in the range of from 0.5 to 50% by weight, more preferably in the range of from 1 to 20% by weight.

The thickness of the photosensitive layer is generally from 5 to 50 μm, more preferably from 10 to 45 μm. In this case also, a remarkable effect is obtained in the case where the thickness is 17 μm or larger. Also in this case, a known plasticizer for improving film-forming properties, flexibility, mechanical strength, etc., an additive for reducing residual potential, a dispersion aid for improving dispersion stability, a leveling agent or surfactant for improving applicability, and other additives such as, e.g., a silicone oil or fluorochemical oil may have been added.

A protective layer may be formed on the photosensitive layer for the purposes of preventing the photosensitive layer from wearing and of preventing/diminishing the deterioration of the photosensitive layer caused by, e.g., a product of discharge generated from charging units, etc.

A surface layer may contain a fluororesin, silicone resin, or the like for the purpose of reducing the frictional resistance or wear of the photoreceptor surface. The surface layer may contain particles of any of these resins or particles of an inorganic compound.

<Measurement Method of Film Thickness of Photosensitive Layer>

The film thickness of the photosensitive layer can be measured by the following method.

In the photoreceptor sheet coated by a known method, the thickness of the substrate is first measured using a starting part of coating or an end part of coating. Namely, the photosensitive layer is peeled off using a solvent capable of dissolving the photosensitive layer (generally, a solvent used at coating). On this occasion, when an undercoat layer is present, the solvent is necessarily a solvent which does not dissolve the underlying layer. In the case of the single-layer type photoreceptor, the photosensitive layer is peeled as it is. In the case of the double-layer type photoreceptor where the charge-generating layer and the charge-transporting layer are superposed, both of the two layers are peeled off. The peeled part can be detected as the thickness of the conductive substrate (including the undercoat layer when the undercoat layer is present).

On the other hand, with regard to the part on which the photosensitive layer is coated, the thickness of the whole sheet is measured on any ten points including the width direction of coating and the traveling direction of coating and an average value is calculated. The thickness of the photosensitive layer can be determined by subtracting the thickness of the substrate (+undercoat layer) determined beforehand from the thickness of the whole sheet.

Namely, the thickness of the photosensitive layer is defined as the thickness of the photosensitive layer itself in the case of the single-layer type photoreceptor and as the thickness of the two layers in the case of the double-layer type photoreceptor.

Incidentally, the measurement can be performed using a gauge head having a diameter of 2 mm on a digital electronic micrometer (K351C model, manufactured by Anritsu Corporation) but any other known film thickness measurement methods may be used.

<Method of Preparing Electrophotographic Photoreceptor>

The method of preparing an electrophotographic photoreceptor to which the present embodiment is to be applied is not particularly limited. Usually, individual layers constituting the photoreceptor may be formed by application on a conductive substrate by a known technique such as die coating, reverse coating, gravure coating, bar coating, or the like known as methods of forming a photosensitive layer of a sheet-shaped electrophotographic photoreceptor.

As forming methods of individual layers, known methods including successively applying coating fluids obtained by dissolving or dispersing in a solvent the materials to be incorporated into layers.

The photoreceptor after coating is subjected to a drying step until the solvent in the coated film is substantially evaporated and removed. As the drying method, any method hitherto known and performed can be applied and, for example, drying may be performed by a heating roller, a hot-air dryer, the above-described dryer, an infrared dryer, and/or a far infrared dryer. The drying temperature is usually in the range of 60 to 140° C.

The sheet-shaped photoreceptor thus obtained is used as an endless belt after both end parts thereof are linked by a known method such as ultrasonic fusion following a step of cutting the photoreceptor into an appropriate size as needed or is used as it is with winding it on a drum. In the case of winding it on a drum, a roll rolled thinly may be stored inside the drum and is wound off or one sheet thereof may be wound on the drum.

In the case of either form, a conductive layer may be provided for earth connection but, in the invention, an exposed uncoated area of the photosensitive layer is present instead of the conductive layer within the surface of the photoreceptor sheet. The uncoated area is usually formed at the end parts within the sheet surface.

<Ease of Peeling with Solvent>

In the case where the sheet-shaped photoreceptor is formed by a known coating method, coating is performed with winding off the conductive substrate wound into a roll shape and then the coated photoreceptor is cut out, so that it is difficult to apply the photosensitive layer only a part of the conductive substrate and hence the whole area of the sheet unavoidably becomes the photosensitive layer. Therefore, in order to obtain the photosensitive layer-uncoated part for ground connection, it is necessary to form the uncoated area by post-processing. Thus, it is necessary to peel the photosensitive layer, e.g., by a peeling solvent, in order to form the uncoated area by post-processing. At that time, the easiness of peeling of the photosensitive layer becomes important.

In the invention, a peeling solvent for use at the formation of the uncoated area is acetone, tetrahydrofuran, or the like from the viewpoint of safety. These may be used alone or two or more thereof may be used in combination. Moreover, 1,4-dioxane, chlorobenzene, or the like is effective for hardly soluble resins, for example, a bisphenol A polycarbonate resin and the like which are widely used in sheet-shaped electrophotographic photoreceptors but there is a concern of causing a safety problem.

<Image-Forming Apparatus>

The embodiment of the image-forming apparatus using the electrophotographic photoreceptor of the invention is explained below by reference to FIG. 1, which illustrates the constitution of important parts of the apparatus. However, embodiments thereof should not be construed as being limited to those explained below, and the apparatus can be modified at will so long as the modifications do not depart from the gist of the invention.

As shown in FIG. 1, the image-forming apparatus includes an electrophotographic photoreceptor 1, a charging device 2, an exposure device 3, and a developing device 4, and the apparatus may further has a transfer device 5, a cleaner 6, and a fixing device (not shown in the figure) according to need.

The electrophotographic photoreceptor 1 is not particularly limited so far as it is any of the electrophotographic photoreceptors of the invention described above, FIG. 1 shows, as an example thereof, an endless belt-shaped photoreceptor composed of a sheet-shaped conductive substrate and, formed on the surface thereof, the photosensitive layer described above and transformed into an endless belt shape by ultrasonic fusion. The charging device 2, exposure device 3, developing device 4, transfer device 5, and cleaner 6 have been disposed along the peripheral surface of this electrophotographic photoreceptor 1.

The charging device 2 serves to charge the electrophotographic photoreceptor 1. It evenly charges the surface of the electrophotographic photoreceptor 1 to a given potential. FIG. 1 shows a corona charging device (corotron) as an example of the charging device 2. Besides the device, corona charging devices such as scorotrons, contact type charging devices such as charging rollers and charging brushes, and the like are frequently used.

In many cases, the electrophotographic photoreceptor 1 and the charging device 2 have been designed to constitute a cartridge (hereinafter suitably referred to as "photoreceptor cartridge") which involves these two members and is designed to be removable from the main body of the image-forming apparatus. When, for example, the electrophotographic photoreceptor 1 and the charging device 2 have deteriorated, this photoreceptor cartridge can be removed from the main body of the image-forming apparatus and a fresh photoreceptor cartridge can be mounted in the main body of the image-forming apparatus. Also with respect to the toner, which will be described later, the toner in many cases has been designed to be stored in a toner cartridge and be removable from the main body of the image-forming apparatus. When the toner in the toner cartridge in use has run out, this toner cartridge can be removed from the main body of the image-forming apparatus and a fresh toner cartridge can be mounted. Furthermore, there are cases where a cartridge including all of the electrophotographic photoreceptor 1, a charging device 2, and a toner is used. Moreover, the electrophotographic photoreceptor 1, a charging device 2 are incorporated into a larger-scale on-demand printing apparatus in some cases.

The exposure device 3 is not particularly limited in kind so long as it can illuminate the electrophotographic photoreceptor 1 and thereby form an electrostatic latent image in the photosensitive surface of the electrophotographic photoreceptor 1. Specific examples thereof include halogen lamps, fluorescent lamps, lasers such as semiconductor lasers and He—Ne lasers, and LEDs. It is also possible to conduct exposure by the technique of internal photoreceptor exposure. Although any desired light can be used for exposure, for example, a monochromatic light having a wavelength of 780 nm or 830 nm, a monochromatic light having a slightly short wavelength of 600 to 700 nm, a monochromatic light having a short wavelength of 380 to 500 nm, a white light after passing through a suitable filter, or the like may be used to conduct exposure.

The developing device 4 is not particularly limited in kind and any devices such as ones operated by a dry development technique, e.g., cascade development, development with one-component conductive toner, or two-component magnetic brush development, a wet development technique, etc. can be used.

The kind of the toner is arbitrary and other than a powder toner, not only a polymerization toner obtained by using suspension polymerization or emulsion polymerization can be used but also a liquid toner can be used in an on-demand printer. Particularly, in the case where the polymerization toner is used, one having such a small particle diameter as about 4 to 8 μm is preferred and, with regard to the shape of the toner particle, various ones from nearly spherical one to potato-like one which is out of spherical one can be used. The polymerization toner is excellent in charging evenness and transferring ability and hence is suitably used for high-definition imaging. The liquid toner can be formed into a diameter of from 1 to 3 μm and is suitable for more highly fine image output.

The transfer device 5 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 5 is one composed of a transfer charger, transfer roller, transfer belt, or the like disposed so as to face the electrophotographic photoreceptor 1. A given voltage (transfer voltage) which has the polarity opposite to that of the charge potential of the toner is applied to the transfer device 5, and this transfer device 5 thus transfers the toner image formed on the electrophotographic photoreceptor 1 to a recording paper (paper or medium) P.

The cleaner 6 is not particularly limited, and any desired cleaner can be used, such as a brush cleaner, magnetic brush cleaner, electrostatic brush cleaner, magnetic roller cleaner, or blade cleaner. The cleaner 6 serves to scrape off the residual toner adherent to the photoreceptor 1 with a cleaning member and thus recover the residual toner.

The toner which has been transferred to the recording paper P is heated to a molten state during the passage through a fixing device. After the passage, the toner is cooled and fixed to the recording paper P.

The fixing device also is not particularly limited in kind. Fixing devices which can be mounted include ones operated by any desired fixing technique, such as heated-roller fixing, flash fixing, oven fixing, or pressure fixing.

In the image-forming apparatus having the constitution described above, image recording is conducted in the following manner. First, the surface (photosensitive surface) of the photoreceptor 1 is charged to a given potential (e.g., −600 V) by the charging device 2. This charging may be conducted with a direct-current voltage or with a direct-current voltage on which an alternating-current voltage has been superimposed.

Subsequently, the charged photosensitive surface of the photoreceptor 1 is exposed by the exposure device 3 according to the image to be recorded. Thus, an electrostatic latent image is formed in the photosensitive surface. This electrostatic latent image formed in the photosensitive surface of the photoreceptor 1 is developed by the developing device 4.

When the charged toner held on the developing roller 4 comes into contact with the surface of the photoreceptor 1, a toner image corresponding to the electrostatic latent image is formed on the photosensitive surface of the photoreceptor 1. This toner image is transferred to a recording paper P by the transfer device 5. Thereafter, the toner which has not been transferred and remains on the photosensitive surface of the photoreceptor 1 is removed by the cleaner 6.

After the transfer of the toner image to the recording paper P, this recording paper P is passed through the fixing device 7 to thermally fix the toner image to the recording paper P. Thus, a finished image is obtained.

Incidentally, the image-forming apparatus may have a constitution in which an erase step, for example, can be conducted, in addition to the constitution described above. The erase step is a step in which the electrophotographic photoreceptor is exposed to a light to thereby erase the residual charges from the electrophotographic photoreceptor. As an eraser, there may be used a fluorescent lamp, LED, or the like. The light to be used in the erase step, in many cases, is a light having such an intensity that the exposure energy thereof is at least 3 times the energy of the exposure light.

The constitution of the image-forming apparatus may be further modified. For example, the apparatus may have a constitution in which steps such as a pre-exposure step and an auxiliary charging step can be conducted, or have a constitution in which offset printing is conducted. Furthermore, the apparatus may have a full-color tandem constitution employing two or more toners. Particularly, the endless belt-shaped photoreceptor is suitable for four-cycle full-color printing in which color images of individual colors are repeatedly developed.

EXAMPLES

The embodiment will be explained below more specifically with reference to Examples. The following Examples are given in order to explain the invention in detail, and the invention should not be construed as being limited to the following Examples unless the invention departs from the spirit thereof. Each "parts" described in the following Examples and Comparative Examples means "parts by weight" unless otherwise indicated.

The measurement of the viscosity-average molecular weight of the binder resin is explained here.

A resin is dissolved in dichloromethane to prepare a solution having a concentration C of 6.00 g/L. Using an Ubbelohde capillary viscometer having a solvent (dichloromethane) flow time $t_0$ of 136.16 seconds, the sample solution is investigated for flow time t in a thermostatic water bath set at 20.0° C. The viscosity-average molecular weight Mv is calculated according to the following equations.

$$a=0.438\times\eta_{sp}+1 \quad \eta_{sp}=t/t_0-1$$

$$b=100\times\eta_{sp}/C \quad C=6.00\ (g/L)$$

$$\eta=b/a$$

$$Mv=3207\times\eta^{1.205}$$

<Production of Photoreceptor Sheet>

Example 1

Rutile titanium oxide having an average primary-particle diameter of 40 nm ("TTO55N" manufactured by Ishihara Sangyo Kaisha, Ltd.) and methyldimethoxysilane ("TSL8117" manufactured by Toshiba Silicone Co., Ltd.) in an amount of 3% by weight based on titanium oxide were charged into a high-speed fluidized mixing kneader ("SMG300" manufactured by Kawata MFG Co., Ltd.). A surface treated titanium oxide obtained by high-speed mixing at a rotation peripheral speed of 34.5 msec was dispersed in a mixed solvent of methanol/1-propanol with a ball mill to thereby form a dispersion slurry of hydrophobized titanium oxide. This dispersion slurry was mixed with a mixed solvent of methanol/1-propanol/toluene and with pellets of a copolyamide composed of ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a composition molar ratio of 60%/15%/5%/15%/5% with stirring under heating to dissolve the polyamide pellets. Thereafter, the resultant mixture was subjected to an ultrasonic dispersion treatment to thereby form a dispersion for undercoat layer having a solid concentration of 18.0% which contained methanol/1-propanol/toluene in a weight ratio of 7/1/2 and the hydrophobized titanium oxide/the copolyamide in a weight ratio of 3/1.

A

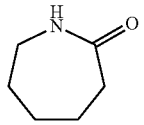

-continued

B

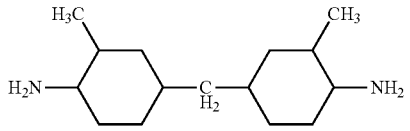

C

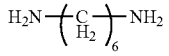

D

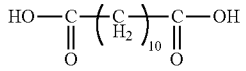

E

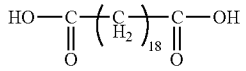

The coating fluid for undercoat layer formation thus obtained was applied with a wire bar onto an aluminum-deposited polyethylene terephthalate (thickness: 75 μm) and dried to form an undercoat layer in a thickness of 1.2 μm on a dry basis.

Figure 2:
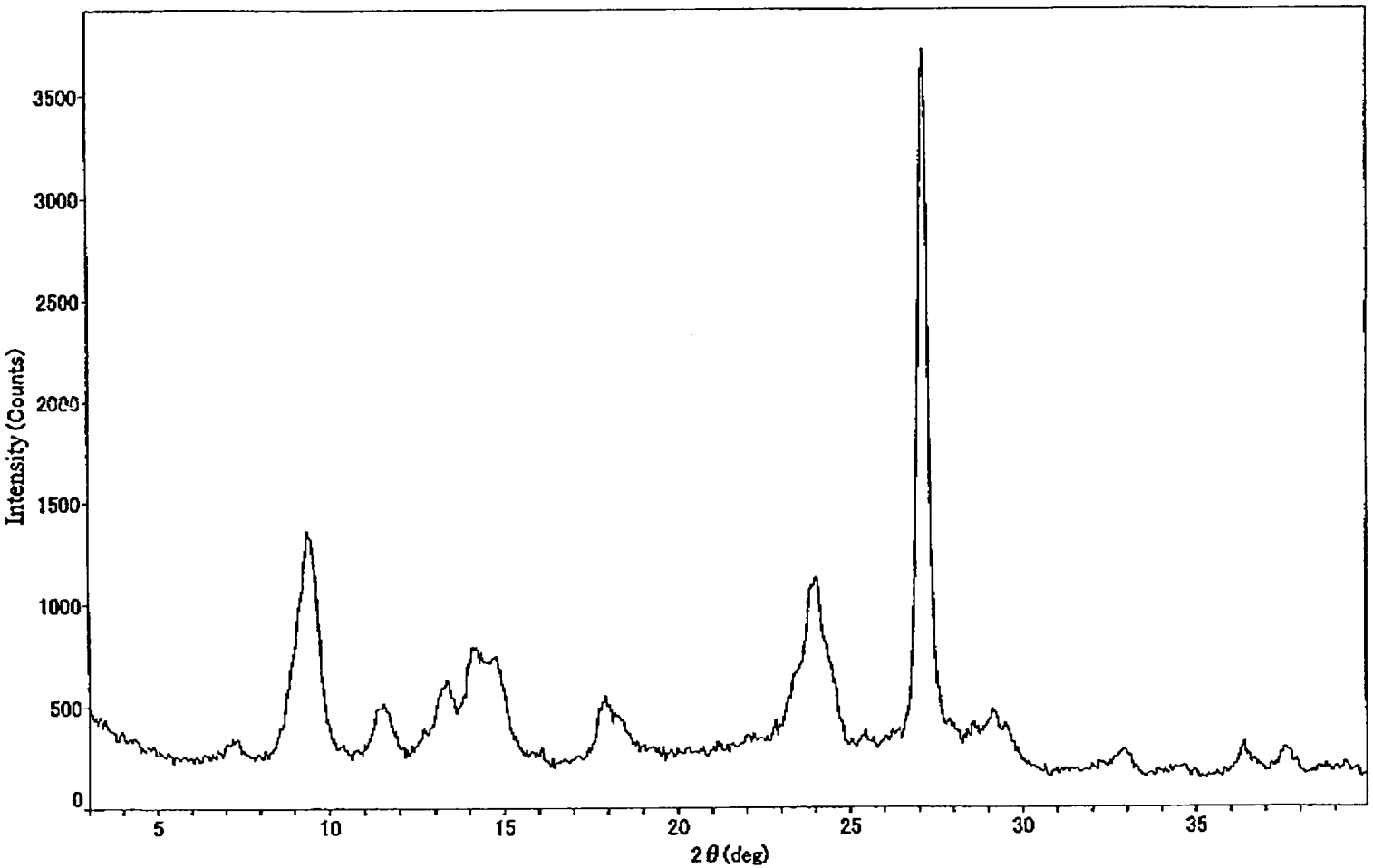
FIG. 2 is an X-ray diffraction pattern of oxytitanium phthalocyanine used in Examples of the invention.
Figure 3:
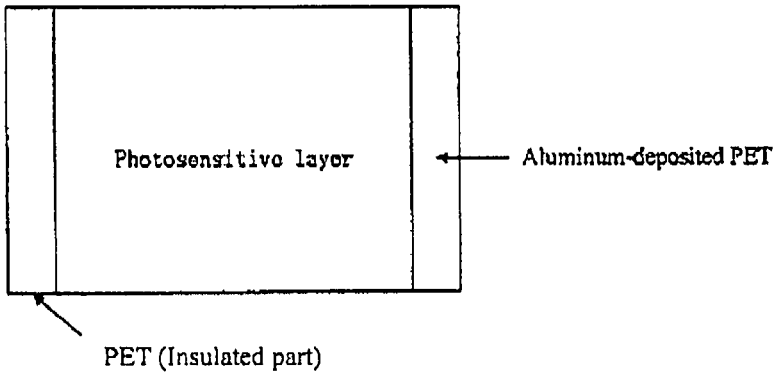
FIG. 3 is a schematic illustration of the photoreceptor sheet used in Examples of the invention.

Then, 10 parts by weight of oxytitanium phthalocyanine showing a strong diffraction peak at a Bragg angle (2θ±0.2) of 27.3° in X-ray diffractometry using a CuKα line and having the powder X-ray diffraction spectrum shown in FIG. 2 was added to 150 parts by weight of 1,2-dimethoxyethane and subjected to a pulverization/dispersion treatment with a sand grinding mill to form a pigment-dispersed fluid. To 160 parts by weight of the pigment-dispersed fluid thus obtained was added 100 parts by weight of a 5% 1,2-dimethoxyethane solution of poly(vinyl butyral) (trade name #6000C manufactured by Denki Kagaku Kogyo K.K.) and an appropriate amount of 1,2-dimethoxyethane to finally prepare a dispersion having a solid concentration of 4.0%.

The dispersion was applied on the aforementioned undercoat layer with a wire bar and then dried to form a charge-generating layer in a thickness of 0.4 μm on a dry basis.

Then, 40 parts by weight of a charge-transporting material of a hydrazone compound shown below, 100 parts by weight of the polycarbonate resin (viscosity-average molecular weight: 22,000) according to the invention composed of the repeating unit (1-1), 0.05 parts by weight of a silicone oil as a leveling agent were mixed into 640 parts by weight of a mixed solvent of tetrahydrofuran and toluene (tetrahydrofuran: 70% by weight, toluene: 30% by weight) to prepare a coating fluid for charge-transporting-layer formation.

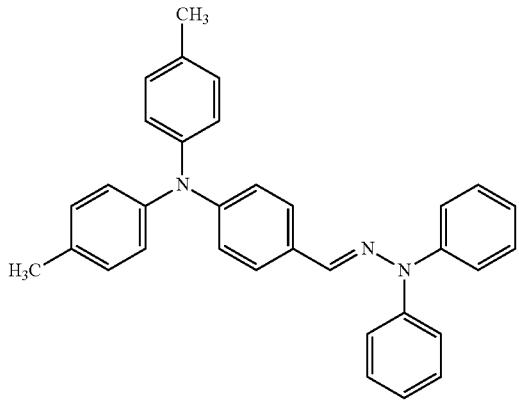

Charge-transporting material

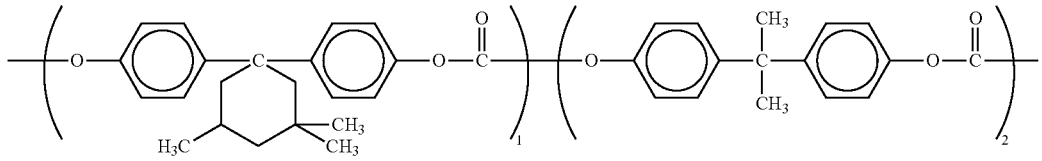

Repeating unit of polycarbonate resin (1-1)

The polycarbonate resin was a resin commercially available as a trade name "APEC" from Bayer AG and was used as it was received without purification.

The fluid was applied on the aforementioned charge-generating layer with an applicator in a thickness of 20 μm on a dry basis and then dried at 125° C. for 20 minutes to form a charge-transporting layer, thereby preparing a photoreceptor sheet A1.

The photoreceptor sheet A1 was cut into a size of 100 mm×251 mm and used for measurement of electrical properties. Also, another sheet of the same one was prepared and the end parts were peeled off with acetone and ethanol to obtain a sample having an uncoated area of 100 mm×100 mm, which was used for adhesion strength test.

Example 2

A photoreceptor sheet B1 was produced in the same manner as in Example 1, except that the polycarbonate resin composed of the repeating unit (1-1) used in the coating fluid for charge-transporting-layer formation of Example 1 was changed to a polycarbonate resin (viscosity-average molecular weight: 22,000) composed of a repeating unit (1-2) having the following structure.

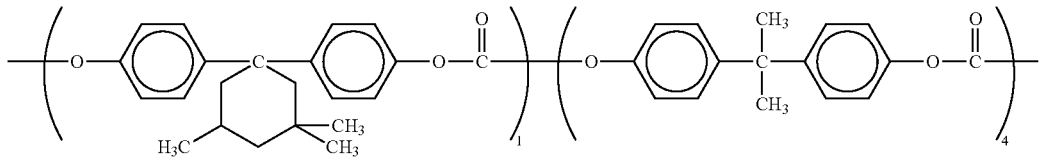

Repeating unit of polycarbonate resin (1-2)

Comparative Example 1

A photoreceptor sheet C1 was produced in the same manner, except that the polycarbonate resin composed of the repeating unit (1-1) used in the coating fluid for charge-transporting-layer formation of Example 1 was changed to a polycarbonate resin (viscosity-average molecular weight: 20,000) only composed of a repeating unit (3) having the following structure.

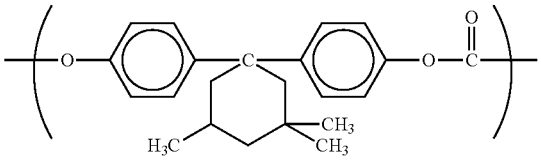

Repeating unit of polycarbonate resin (3)

Comparative Example 2

It was intended to produce a photoreceptor sheet in the same manner as in Example 1 except that the polycarbonate resin composed of the repeating unit (1-1) used in the coating fluid for charge-transporting-layer formation of Example 1 was changed to a polycarbonate resin (viscosity-average molecular weight: 30,000) composed of a repeating unit (bisphenol A) having the following structure but the resin was not dissolved in the mixed solution of tetrahydrofuran/toluene. Therefore, the solvent was changed to 100% 1,4-dioxane and a photoreceptor sheet D1 was produced.

Moreover, also at the preparation of a sheet for adhesiveness test, since peeling was difficult with acetone, 1,4-dioxane was used also as a peeling solvent.

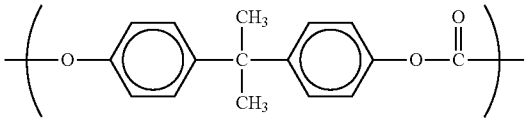

Comparative Example 3

A photoreceptor sheet E1 was produced in the same manner, except that the polycarbonate resin composed of the repeating unit (1-1) used in the coating fluid for charge-transporting-layer formation of Example 1 was changed to a polycarbonate resin (viscosity-average molecular weight: 20,000) only composed of a repeating unit (bisphenol Z) having the following structure.

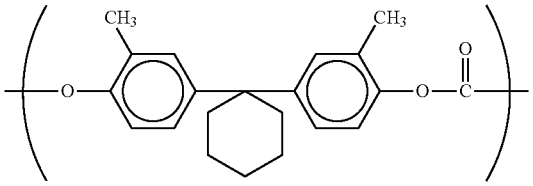

Comparative Example 4

It was intended to produce a photoreceptor sheet in the same manner as in Example 1 except that the polycarbonate resin composed of the repeating unit (1-1) used in the coating fluid for charge-transporting-layer formation of Example 1 was changed to a mixture of 33 parts of a polycarbonate resin (viscosity-average molecular weight: 20,000) only composed of a repeating unit (3) having the following structure and 67 parts of a polycarbonate resin (viscosity-average molecular weight: 30,000) composed of a repeating unit (bisphenol A) having the following structure but the resin was not dissolved in the mixed solution of tetrahydrofuran/toluene. Therefore, the solvent was changed to 100% 1,4-dioxane and a photoreceptor sheet F1 was produced.

Moreover, also at the preparation of a sheet for adhesiveness test, since peeling was difficult with acetone, 1,4-dioxane was used also as a peeling solvent.

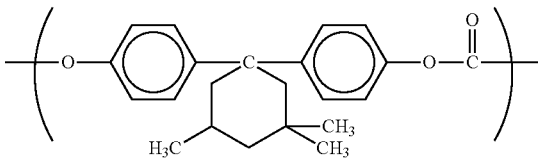

Repeating unit of polycarbonate resin (3)

-continued

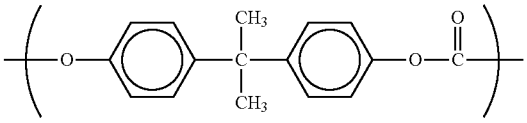

Repeating unit of bisphenol A

Example 3

A photoreceptor sheet A2 was obtained in the same manner as in Example 1 except that the film thickness of the photosensitive layer was 13 μm.

Example 4

A photoreceptor sheet B2 was obtained in the same manner as in Example 2 except that the film thickness of the photosensitive layer was 13 μm.

Comparative Example 5

A photoreceptor sheet C2 was obtained in the same manner as in Comparative Example 1 except that the film thickness of the photosensitive layer was 13 μm.

Comparative Example 6

A photoreceptor sheet D2 was obtained in the same manner as in Comparative Example 2 except that the film thickness of the photosensitive layer was 13 μm.

Comparative Example 7

A photoreceptor sheet E2 was obtained in the same manner as in Comparative Example 3 except that the film thickness of the photosensitive layer was 13 μm.

Comparative Example 8

A photoreceptor sheet F2 was obtained in the same manner as in Comparative Example 4 except that the film thickness of the photosensitive layer was 13 μm.

Reference Example 1

The coating fluid for undercoat layer formation obtained in Example 1 was applied onto a non-anodized aluminum cylinder (outer diameter: 80 mm, length: 350 mm, thickness: 1 mm) by dipping it to the position of 320 mm from the lower end of the cylinder to form an undercoat layer in a thickness of 1.2 μm on a dry basis.

Then, the aluminum cylinder on which the undercoat layer had been provided was dipped into the pigment-dispersed fluid of oxytitanium phthalocyanine obtained in Example 1 to the position of 320 mm from the lower end of the cylinder to apply the fluid, thereby forming a charge-generating layer in a thickness of 0.4 μm on a dry basis.

Furthermore, the coating fluid for charge-transporting-layer formation obtained in Example 1 was applied onto the aforementioned charge-generating layer by dipping the cylinder to the position of 320 mm from the lower end thereof in a thickness of 20 μm on a dry basis, thereby obtaining a photoreceptor drum G1 having a multilayer type photosensitive layer.

Two pieces of the same drum were produced and one drum was used for the electrical property test and another one for the adhesiveness test. Since the dip coating method was used, an uncoated area could be formed without peeling with a solvent.

Reference Example 2

A photoreceptor drum H1 was produced in the same manner as in Reference Example 1, except that the polycarbonate resin composed of the repeating unit (1-1) used in the coating fluid for charge-transporting-layer formation of Reference Example 1 was changed to a polycarbonate resin (viscosity-average molecular weight: 22,000) composed of a repeating unit (1-2) having the following structure.

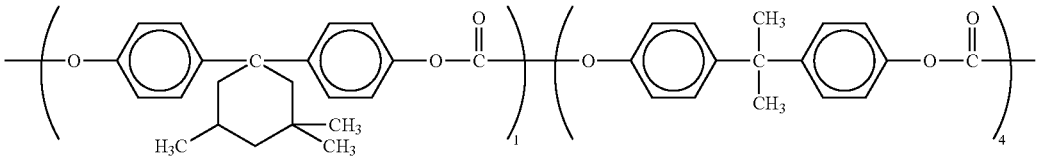

Repeating unit of polycarbonate resin (1-2)

Reference Example 3

A photoreceptor drum I1 was produced in the same manner as in Reference Example 1, except that the polycarbonate resin composed of the repeating unit (1-1) used in the coating fluid for charge-transporting-layer formation of Reference Example 1 was changed to a polycarbonate resin (viscosity-average molecular weight: 20,000) only composed of a repeating unit (3) having the following structure.

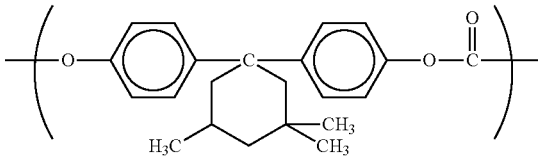

Repeating unit of polycarbonate resin (3)

Reference Example 4

It was intended to produce a photoreceptor drum in the same manner as in Reference Example 1 except that the poly carbonate resin composed of the repeating unit (1-1) used in the coating fluid for charge-transporting-layer formation in Reference Example 1 was changed to a polycarbonate resin (viscosity-average molecular weight: 30,000) composed of a repeating unit (bisphenol A) having the following structure but the resin was not dissolved in the mixed solution of tetrahydrofuran/toluene. Therefore, the solvent was changed to 100% 1,4-dioxane and a photoreceptor drum J1 was produced.

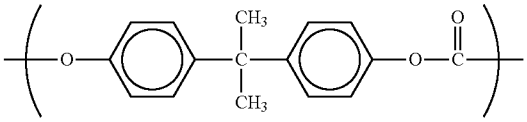

Reference Example 5

A photoreceptor drum K1 was produced in the same manner, except that the polycarbonate resin composed of the repeating unit (1-1) used in the coating fluid for charge-transporting-layer formation of Reference Example 1 was changed to a polycarbonate resin (viscosity-average molecular weight: 20,000) only composed of a repeating unit (bisphenol Z) having the following structure.

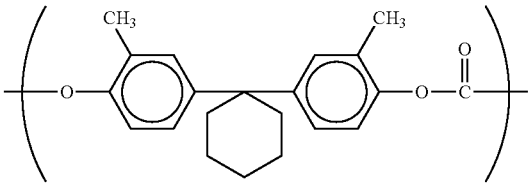

Reference Example 6

It was intended to produce a photoreceptor drum in the same manner as in Example 1 except that the polycarbonate resin composed of the repeating unit (1-1) used in the coating fluid for charge-transporting-layer formation in Reference Example 1 was changed to a mixture of 33 parts of a polycarbonate resin (viscosity-average molecular weight: 20,000) only composed of a repeating unit (3) having the following structure and 67 parts of a polycarbonate resin (viscosity-average molecular weight: 30,000) composed of a repeating unit (bisphenol A) having the following structure but the resin was not dissolved in the mixed solution of tetrahydrofuran/toluene. Therefore, the solvent was changed to 100% 1,4-dioxane and a photoreceptor drum L1 was produced.

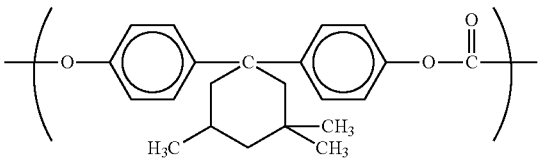

Repeating unit of polycarbonate resin (3)

-continued

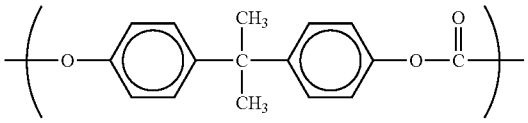

Repeating unit of bisphenol A

For the photoreceptor sheets A1, B1, C1, D1, E1, F1, A2, B2, C2, D2, E2, and F2 and photoreceptor drums G1, H1, I1, J1, K1, and L1 produced, the following electrical property test and adhesiveness test were performed. The results are summarized in Table 1.

after the exposure, the surface potential (hereinafter sometimes referred to as VL) was measured. This measurement was made in an environment having a temperature of 25° C. and a relative humidity of 50%.

<Adhesiveness Test>

Adhesiveness of the photosensitive layer was tested by cutting an adhesive cellophane tape (manufactured by Nichiban Co., Ltd.) into a length of 100 mm and attaching it on the photosensitive layer part over a length of 50 mm and the uncoated part over a length, of 30 mm in the photoreceptor sheet or the photoreceptor drum having the uncoated area and lifting up the tape slantwise at an angle of 45° with holding the tape at remaining 20 mm length part (which continued to the part attached to the uncoated part).

TABLE 1

| | | | Resin unit | CTM | Film thickness μm | Electrical property VL −V | Adhesiveness |
|---|---|---|---|---|---|---|---|
| Example | 1 | A1 | (1-1) | Hydrazone | 20 | 60 | Good |
| | 2 | B1 | (1-2) | idem | 20 | 58 | Good |
| | 3 | A2 | (1-1) | idem | 13 | 35 | Good |
| | 4 | B2 | (1-2) | idem | 13 | 34 | Good |
| Comparative | 1 | C1 | (3) | idem | 20 | 60 | Bad |
| Example | 2 | D1 | Bisphenol A | idem | 20 | 75 | Good |
| | 3 | E1 | Bisphenol Z | idem | 20 | 72 | Medium |
| | 4 | F1 | (3)/bis A | idem | 20 | 70 | Medium |
| | 5 | C2 | (3) | idem | 13 | 35 | Medium |
| | 6 | D2 | Bisphenol A | idem | 13 | 43 | Good |
| | 7 | E2 | Bisphenol Z | idem | 13 | 42 | Good |
| | 8 | F2 | (3)/bis A | idem | 13 | 40 | Medium |
| Reference | 1 | G1 | (1-1) | idem | 20 | 59 | Good |
| Example | 2 | H1 | (1-2) | idem | 20 | 59 | Good |
| | 3 | I1 | (3) | idem | 20 | 58 | Good |
| | 4 | J1 | Bisphenol A | idem | 20 | 74 | Good |
| | 5 | K1 | Bisphenol Z | idem | 20 | 72 | Good |
| | 6 | L1 | (3)/bis A | idem | 20 | 70 | Good |

Good: Exfoliation from the end part of the photosensitive layer was not observed at all.

Medium: Exfoliation from the end part of the photosensitive layer was observed but a part thereof remained.

Bad: Exfoliation from the end part of the photosensitive layer was severely observed and the whole layer was removed.

<Electrical Property Test>

Using an apparatus for electrophotographic-property evaluation produced in accordance with the measurement standards adopted by the Society of Electrophotography of Japan (described in Zoku Denshishashin Gijutsu No Kiso To Oyo, edited by the Society of Electrophotography of Japan, Corona Publishing Co., Ltd., pp. 404-405), after each of the photoreceptor sheets A1 to F2 was attached to an aluminum-made drum having a diameter of 80 mm to form a cylindrical one and the aluminum-made drum was electrically connected to the aluminum substrate of the photoreceptor sheet, each of the cylindrical ones and the photoreceptor drums G1 to L1 as they were was rotated at a constant rotation speed of 60 rpm and subjected to an electrical property evaluation test in which a cycle including charging, exposure, potential measurement, and erase was conducted. In this test, the photoreceptor was charged so as to result in an initial surface potential of −700 V, and exposed at 1.0 μJ/cm$^2$ to the monochromatic light of 780 nm obtained by converting the light from a halogen lamp with an interference filter. At 180 milliseconds From the results, in the case where the polycarbonate in which a repeating unit is only composed of the structural formula (3) is used, the electrical properties of the photoreceptors C1 and C2 are good but exfoliation from the end part of the photosensitive layer takes place, so that a problem exists on actual use. Moreover, the photoreceptors D1, D2, E1, and E2 using a resin only composed of bisphenol A or bisphenol Z which is well known as a resin for photoreceptors are poor in electrical properties. Furthermore, even when these resins are mixed, the superior points of both properties cannot be maintained and only the poor points are rather emphasized.

On the other hand, it is understood that the photoreceptors A1, A2, B1, and B2 using the copolycarbonate resin according to the invention are excellent in both of the electrical properties and adhesiveness.

Furthermore, like the polycarbonate resin of bisphenol A, it was confirmed that no problem was observed on the solubility toward solvents.

As is understood from Reference Examples, in the case where a drum-shaped conductive substrate is used, no problem is observed on adhesiveness even when any binder resin is used. Thus, when the homopolymer of the structural formula (3) is used, photoreceptor drums having good electrical properties and showing no problem on adhesiveness can be obtained even when the resin according to the invention is not used.

Moreover, in the production of the drum-shaped photoreceptors, since the photosensitive layer is generally formed by dipping, it is not necessary to peel the photosensitive layer by post-processing and thus easy peeling is not required.

From the above, the use of the copolycarbonate resin according to the invention exhibits an effect in the case of the sheet-shaped conductive substrates and particularly exhibits an effect in the case where a photosensitive layer-uncoated area is present within the sheet surface.

Example 5

An aluminum-deposited film was provided in a thickness of 70 nm on the surface of a biaxially oriented polyethylene terephthalate film having a width of 500 mm and a thickness of 75 μm, surface of which had been roughened (Ra=0.1 μm) by incorporating silica particles in the film. The resulting film was wound to form a roll having a length of 2000 m.

Then, aluminum oxide particles having an average primary-particle diameter of 13 nm (Aluminum Oxide C manufactured by Nippon Aerosil Co., Ltd.) was dispersed in a mixed solvent of methanol/1-propanol by ultrasonic wave to thereby form a dispersion slurry of aluminum oxide. This dispersion slurry was mixed with a mixed solvent of methanol/1-propanol (weight ratio: 7/3) and with pellets of a copolyamide used in Example 1 with stirring under heating to dissolve the polyamide pellets. Thereafter, the resultant mixture was subjected to an ultrasonic dispersion treatment to thereby form a dispersion having a solid concentration of 8.0% which contained aluminum oxide/the copolyamide in a weight ratio of 1/1.

The coating fluid for undercoat-layer formation was applied by reverse coating onto the aluminum-deposited polyethylene terephthalate film while winding off the film from the roll to form an undercoat layer in a thickness of 1.2 μm on a dry basis.

Then, 10 parts by weight of oxytitanium phthalocyanine showing strong diffraction peaks at Bragg angles (2θ±0.2) of 9.3°, 10.6°, 13.2°, 15.1°, 15.7°, 16.1°, 20.8°, 23.3°, 26.3°, and 27.1° in X-ray diffractometry using a CuKα line and 150 parts by weight of 4-methoxy-4-methyl-2-pentanone were mixed and subjected to a pulverization/dispersion treatment with a sand grinding mill to form a pigment-dispersed fluid. Into the pigment-dispersed fluid were mixed 50 parts by weight of a 5% by weight 1,2-dimethoxyethane solution of poly(vinyl butyral) (trade name Denka Butyral #6000C manufactured by Denki Kagaku Kogyo K.K.) and 50 parts by weight of a 5% by weight 1,2-dimethoxyethane solution of a phenoxy resin (trade name PKHH manufactured by Union Carbide Corporation), and an appropriate amount of 1,2-dimethoxyethane was further added thereto to finally prepare a dispersion having a solid concentration of 4.0%.

The coating fluid for charge-generating-layer formation thus obtained was applied by reverse coating onto the aluminum-deposited polyethylene terephthalate film on which the undercoat layer had been formed, while winding off the film from the roll, to form a charge-generating layer in a thickness of 0.4 μm on a dry basis.

Then, 45 parts by weight of the charge-transporting material composed of isomers containing a compound of the following structure shown in JP-A-2002-80432, 100 parts by weight of a polycarbonate resin (viscosity-average molecular weight: 22,000) according to the invention composed of the repeating unit (1-1), 8 parts by weight of an antioxidant (trade name Irganox 1076 manufactured by Ciba-Geigy), and 0.05 parts by weight of a silicone oil as a leveling agent were mixed into 640 parts by weight of a mixed solvent of tetrahydrofuran and toluene (tetrahydrofuran 70% by weight, toluene 30% by weight) to prepare a coating fluid for charge-transporting-layer formation.

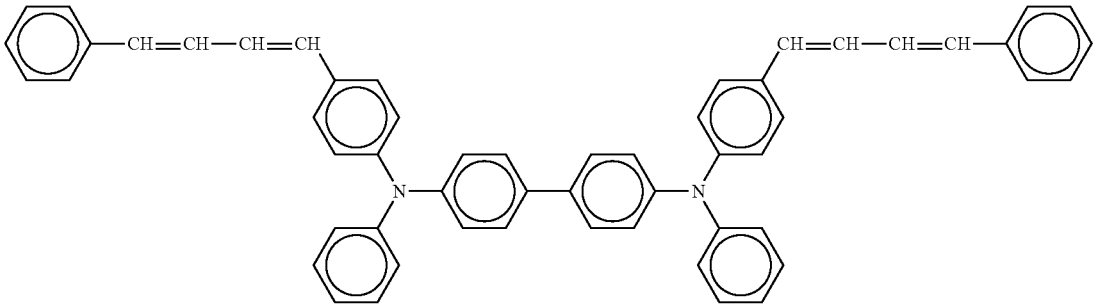

Charge-transporting material

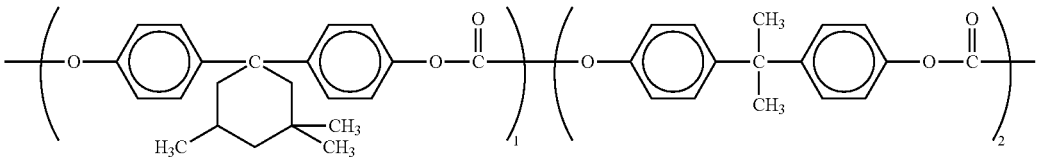

Repeating unit of polycarbonate resin (1-1)

The coating fluid for charge-transporting-layer formation thus obtained was applied by die coating onto the aluminum-deposited polyethylene terephthalate film on which the undercoat layer and the charge-transporting layer had been formed, while winding off the film from the roll, to form a charge-transporting layer in a thickness of 18 μm on a dry basis.

The thus obtained roll-shaped sheet on which a photosensitive layer had been applied was cut into a size of 353 mm×584 mm using a continuous cutting machine to obtain a photoreceptor sheet. Furthermore, the photosensitive layer was peeled from both ends of the sheet in a width of 25 mm each with acetone and ethanol and the aluminum-deposited layer was also removed with a sodium hydroxide solution at one end. Thus, an electrophotographic photoreceptor M was obtained.

The following actual machine test was performed for the photoreceptor sheet M produced.

<Actual Machine Test>

The photoreceptor sheet M was mounted on an on-demand printer, TurboStream manufactured by Hewlett-Packard Co., and image evaluation was performed. In the mounting, the photoreceptor sheet was wound on the aluminum drum in the machine and the uncoated areas at both ends were overlapped to hold the photoreceptor sheet M on the drum. Since the aluminum layer at one end had been removed, they could be easily overlapped with electrostatic action.

Using the photoreceptor M, 100 sheets of a half-tone image was continuously output but good images were obtained without density change. Furthermore, troubles such as exfoliation of the photosensitive layer from the end part in the machine were not observed and there was no problem on the actual use.

From the above, it is understood that a photoreceptor excellent in all of electrical properties, image properties, and actual usability (adhesiveness) can be first obtained only in the case where the polycarbonate resin according to the invention is used.

This application is based on Japanese patent application JP 2010-124832, filed on May 31, 2010, the entire content of which is hereby incorporated by reference, the same as if set forth at length.

What is claimed is:

1. An electrophotographic photoreceptor comprising a sheet-shaped conductive substrate and a photosensitive layer provided thereon, wherein the electrophotographic photoreceptor contains both a photosensitive layer-uncoated area and an insulated part within the sheet surface, and the photosensitive layer contains a copolycarbonate resin having a repeating structure represented by the following general formula (1):

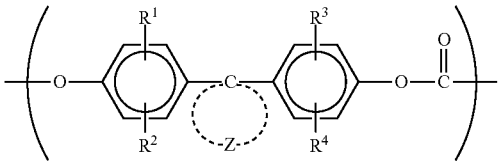

wherein $R^1$, $R^2$, $R^3$ and $R^4$ each independently represent a hydrogen atom or an alkyl group having 4 or less carbon atoms, Z forms a saturated cyclic aliphatic alkyl group having 5 to 8 carbon atoms including the carbon atom to be bonded, and the saturated cyclic aliphatic alkyl group has one to three methyl groups as substituent(s), wherein the photosensitive layer is the outermost layer of the electrophotographic photoreceptor.

2. The electrophotographic photoreceptor according to claim 1, wherein the copolycarbonate resin is a copolymer of the repeating structure represented by the general formula (1) above and a repeating structure represented by the following structural formula (2):

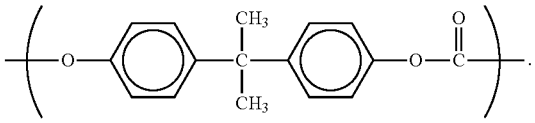

3. The electrophotographic photoreceptor according to claim 2, wherein, in the copolycarbonate resin, the molar ratio of the repeating structure represented by the structural formula (2) is larger than the molar ratio of the repeating structure represented by the general formula (1).

4. The electrophotographic photoreceptor according to claim 2, wherein, in the copolycarbonate resin, the molar ratio of the repeating structure represented by the structural formula (2) is twice or more the molar ratio of the repeating structure represented by the general formula (1).

5. The electrophotographic photoreceptor according to claim 1, wherein the general formula (1) is represented by the following structural formula (3):

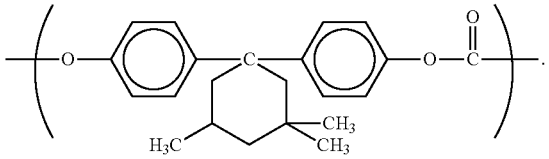

6. The electrophotographic photoreceptor according to claim 1, wherein the thickness of the photosensitive layer is 17 μm or larger.

7. An image-forming apparatus comprising the electrophotographic photoreceptor according to claim 1.

8. The electrophotographic photoreceptor according to claim 1, wherein an undercoat layer is disposed between the conductive substrate and the photosensitive layer.

9. The electrophotographic photoreceptor according to claim 8, wherein the undercoat layer has a thickness of from 0.1 μm to 25 μm.

10. The electrophotographic photoreceptor according to claim 1, wherein the photosensitive layer is a single layer comprising a charge-generating material dispersed in a charge-transporting medium.

11. The electrophotographic photoreceptor according to claim 1, wherein the photosensitive layer comprises a charge-generating layer and a charge-transporting layer.

* * * * *